United States Patent [19]

Karg

[11] Patent Number: 4,874,294

[45] Date of Patent: Oct. 17, 1989

[54] OIL WELL PUMP CONTROL

[76] Inventor: Thomas A. Karg, 203 W. Fourth St., Oil City, Pa. 16301

[21] Appl. No.: 198,501

[22] Filed: May 25, 1988

[51] Int. Cl.[4] ..... F04B 49/02

[52] U.S. Cl. ..... 417/12; 417/43; 417/44; 166/64

[58] Field of Search ..... 417/12, 43, 44; 166/53, 166/64, 65.1

[56] References Cited

U.S. PATENT DOCUMENTS

| | | | |
|---|---|---|---|
| 1,754,946 | 4/1930 | Haskell | 137/101.25 |
| 2,944,488 | 7/1960 | Meyer | 417/43 |
| 3,050,003 | 8/1962 | Edwards | 417/43 X |
| 3,072,059 | 1/1963 | Heffel | 417/43 |
| 3,091,179 | 5/1963 | Echols | 417/44 |
| 3,274,940 | 9/1966 | Cottrell | 417/12 |
| 3,276,380 | 10/1966 | Stevenson | 417/43 X |
| 3,559,731 | 2/1971 | Stafford | 166/53 |
| 3,568,771 | 3/1971 | Vincent et al. | 166/250 |
| 3,614,761 | 10/1971 | Rehm et al. | 417/43 |
| 3,936,231 | 2/1976 | Douglas | 417/43 X |
| 4,118,148 | 10/1978 | Allen | 417/43 X |
| 4,119,865 | 10/1978 | Elderton | 417/43 X |
| 4,329,120 | 5/1982 | Walters | 417/12 |
| 4,744,729 | 5/1988 | Hasten et al. | 417/12 |
| 4,749,925 | 6/1988 | Wilkins | 417/12 X |
| 4,781,536 | 11/1988 | Hicks | 417/43 X |

*Primary Examiner*—Carlton R. Croyle
*Assistant Examiner*—Leonard P. Walnoha
*Attorney, Agent, or Firm*—Carothers & Carothers

[57] ABSTRACT

An oil well pump control for regulating operation of a pumping apparatus such as a pumping jack through a timing system which is actuated by the fluid pulses or surges that result from the pumping action of the pump.

13 Claims, 2 Drawing Sheets

OIL WELL PUMP CONTROL

BACKGROUND OF THE INVENTION

In the art of oil well pumping it is well known to provide a motor driven pumping jack for lifting oil in discreet slugs or pulses from the pocket at the bottom of the well bore to the surface. Such a pumping system typically comprises a power driven jack or beam which reciprocates on a pivot to reciprocate a string of well rod up and down in the well casing. A working barrel is connected to the well rod string adjacent its lowermost end for reciprocation in unison therewith within the well pocket to thereby provide the lifting or pumping action which delivers the crude oil and brine from the well pocket to the head at the surface, and thence via suitable production piping to a holding tank or similar storage facility.

The rate at which the crude oil in an oil well migrates to the well bore and fills the well pocket may vary widely from one well to another depending upon specific geologic conditions in the oil bearing sands, and the age of the oil field in terms of the proportion of recoverable crude oil which has been removed from the geologic formations. In mature wells, commonly known as stripper wells, the maximum attainable production rate will depend entirely on how quickly the spontaneous migration of crude oil to the well pocket can fill the pocket. Typically, in such wells the pumping capacity of the pumping jack is far greater than the capacity of the field to refill well pocket with crude oil from the oil bearing formations. Even in newer, more productive wells the pumping capacity of the pumping jack may far exceed spontaneous well pocket refill rates.

To accommodate these and other conditions and limitations of oil well production, practitioners of the art have proposed numerous systems for controlling well production. For example, U.S. Pat. No. 1,754,946 discloses a pressure differential control valve system for use in the control of well flow. U.S. Pat. No. 3,276,380 discloses a mechanical float in a float chamber which is operable according to the level of fluid within the float chamber to influence pump operation responsive to a reduction of the volume of fluid passing through the production conduit at the earth's surface. U.S. Pat. No. 3,050,003 discloses a pressure actuated valve which operates switch contacts to control a well pump motor. U.S. Pat. No. 3,274,940 discloses a well pump control system with a float chamber connected to the production piping upstream of a pressure control valve to control pump motor operation. Also disclosed is a conduit apparently for equalizing pressure on upstream and downstream sides of the pressure control valve.

Other patents which typify the prior art include U.S. Pat. Nos. 4,329,120 (protector apparatus for a down hole pump), 3,614,761 (flow sensors for a drilling mud circulation system), 3,559,731 (adjustable timed off cycles in a well pump control system), 3,072,059 (a flow control valve with electrical contacts that are utilized to control a pump motor), 3,568,771 (controlling pump RPM as a function of the crude oil bulk density) and 2,944,488 (pump control system including a venturi for maintaining constant fluid pressure in a flow conduit.

There remains in the art a need for improved control of pumping jack operation to control pumping time in a manner that the pumping jack does not continue to operate when a well is pumped off, that is when the well pocket is dry. It is desirable that pump operation be terminated at the end of the normal productive pumping cycle of an oil well when the flow rate of fluid to the surface has decreased and level of fluid in the pocket is low. Without effective control of pumping jack operation, the jack will continue to pump when there is not sufficient fluid above the working barrel in the well pocket. This would result in increased crude oil production costs and wear and tear on the pumping mechanism.

Additionally, in many producing fields today, multiple wells are connected to a single stock tank such that the head pressure against which the pumping jack must work in any given well may be constantly changing. This can present production control problems, especially in systems that are balanced for production at a uniform pressure condition. The prior art has not provided entirely satisfactory solutions to the above-characterized and other production problems.

BRIEF SUMMARY OF THE INVENTION

I have invented a new and improved well pump-off control system and method which reliably terminates pumping jack operation when the well is pumped off (i.e., the well pocket fluid level is low). The control system according to my invention detects the pressure and/or volume pulses or surges of fluid flow coming from the well head with each stroke of the pumping jack and terminates pump operation when the magnitude of certain detected fluid surge parameters of pressure or fluid flow pulse decrease below a predetermined limit.

More specifically, my invention contemplates the placement of a flow restriction such as an orifice in the production line between the well head and the holding tank. The flow restriction is utilized as a surge amplifier to amplify the magnitude of the fluid surges coming from the well head independent of pressure conditions downstream of the flow restriction, which may vary according to downstream conditions such as the number of producing wells which are connected or manifolded into a common holding tank and the number of such wells which may be pumping at any given time. The fluid surges upstream of the flow restriction are utilized to control a resettable timer which in turn controls power feed to the pumping jack motor. The timer is set to time out and terminate power supply to the pumping jack motor after a predetermined time, but is reset during operation to begin its timing cycle again with each fluid surge of sufficient magnitude. In this manner, pumping jack operation is limited to operation in a sequence of overlapping time cycles created by starting the timer on a new time cycle before the prior such cycle has expired. Pump operation is terminated at the first instance of a timer cycle expiring before a fluid surge of sufficient magnitude to start a new timer cycle is detected.

Other aspects of my invention include utilization of a start up timer to permit initial pump operation for a start-up time period in excess of the usual timed pumping cycle so that fluid production pressure and flow can develop sufficient surge magnitudes to allow continued pumping under control of the resettable timer until the well is pumped off. Also contemplated is a means for detecting the duration of a fluid surge as a measure of its magnitude in addition to pressure detection, satisfaction of both conditions being necessary to continue pumping jack operation. The invention still further contemplates detection of fluid flow surge magnitude in lieu of or in addition to fluid pressure surge magnitude to control the timed cycle of pumping jack operation.

Advantages of my pump-off control system include more reliable termination of pumping jack operation when there is insufficient fluid above the working barrel in the well pocket to sustain economical well production. Reduced production cost results, as well as reduced wear and tear on the pumping mechanism. My pump-off control will permit well production to continue only when there is sufficient fluid in the well pocket. At insufficient fluid levels, both the flow rates and pressure surges of pumping jack operation will be of insufficient magnitude and duration to reset the pumping jack motor timer control. The timer thus times out and the pumping jack ceases operation until restarted either manually or by an automatic recovery timer.

It is therefore one object of my invention to provide an novel and improved well pump-off control apparatus and method.

It is a further object of my invention to provide control of a well pumping jack operating cycle by utilizing amplified fluid surges, which result with each cycle of pumping jack operation, to control operation of the pumping jack motor.

It is the further object of my invention to provide control of a pumping jack motor by detecting both the magnitude and duration of pressure or flow surges produced by the cyclic operation of the pumping jack in a manner to provide an additional predetermined interval of pump operation each time a surge of sufficient magnitude and duration is detected.

These and other objects and further advantages of the invention will be more fully appreciated upon consideration of the following detailed description and the accompanying drawings, in which.

Figure 1:
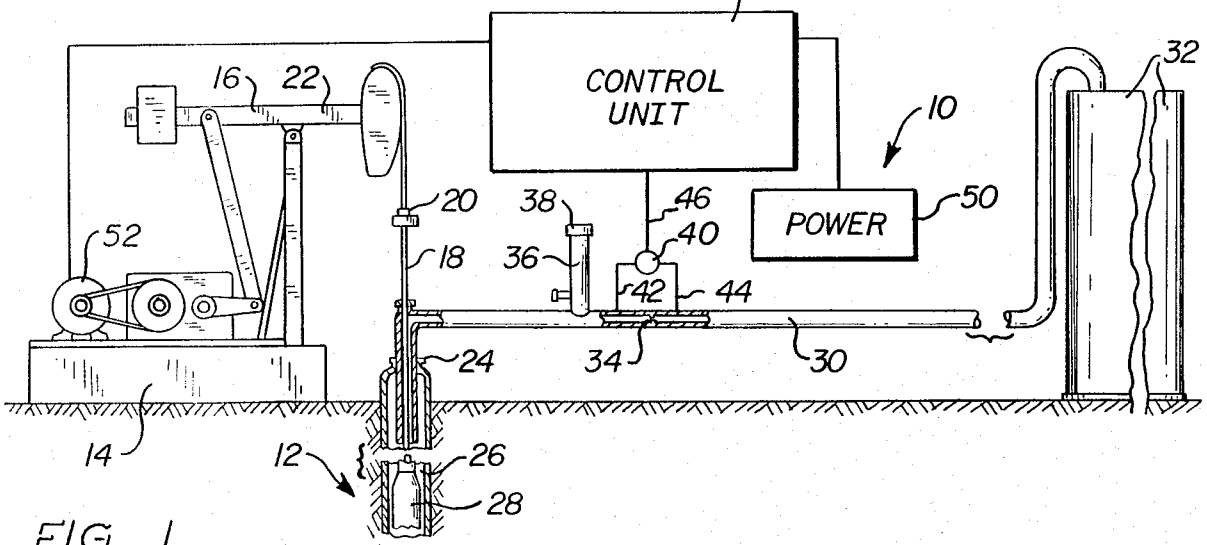
FIG. 1 is a generally schematic illustration of a well production system including a pumping jack and a well pump-off control system according to one presently preferred embodiment of the instant invention.

There is generally indicated at 10 in FIG. 1 a pumping system for pumping crude oil from a well bore 12, the pumping system comprising a base or foundation 14 having a conventional pumping jack 16 mounted thereon with a rod string 18 extending from a connection 20 adjacent one end of the rocker beam 22 of pumping jack 16. The rod string 18 extends downwardly through a well head 24 into the well pocket 26 adjacent the bottom of the well bore, where it is connected to a working barrel 28 that is operable in the well known manner to move crude oil to the surface and thence through production piping 30 to a stock tank or holding tank 32.

Figure 2:
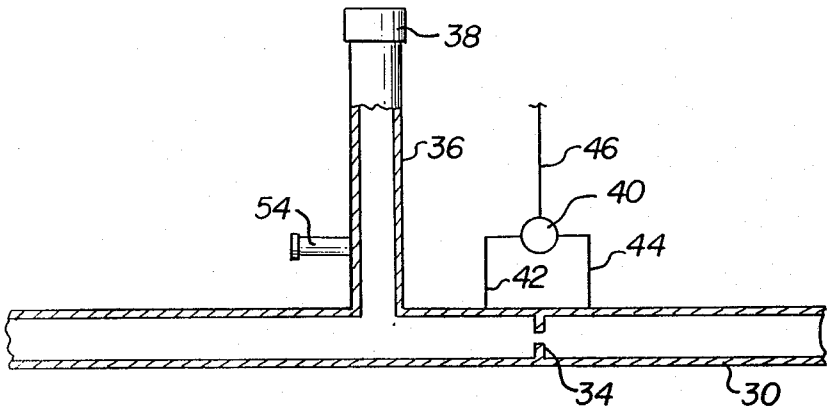
FIG. 2 is a sectioned fragmentary portion of FIG. 1.

Referring to FIGS. 1 and 2, production piping 30 between well head 24 and tank 32 includes a flow restriction such as an orifice plate 34 and a vertical surge tube 36 located upstream from orifice 34, with respect to the direction of oil flow in piping 30. Surge tube 36 is closed by a cap element 38 adjacent its uppermost end.

A pressure detector element such as a pressure switch 40 communicates via the pressure conducting conduits 42 and 44 with the interior of piping 30 at locations respectively upstream and downstream of orifice 34. On each pumping stroke of pumping jack 16 (the upstroke, the downstroke, or both) a fluid surge is created in piping 30, the surge being amplified by the presence of orifice 34 so that the surge pressure upstream of orifice 34 significantly exceeds that on the downstream side of orifice 34. Actuation of pressure switch 40 by such a pressure surge of sufficient magnitude generates a control signal which is transmitted via a control line 46 to a control unit 48 which, in turn, controls the delivery of motive power from a power source 50 to a motor 52 which drives pumping jack 16. In lieu of or in addition to pressure switch 40, surge tube 36 may be of suitable structure such as non-metallic piping to accommodate a suitable detector such as a capacitance sensor 54 mounted on surge tube 36 intermediate the upper and lower ends thereof. Each repeated flow impulse created by successive pumping strokes of pumping jack rocker beam 22 causes an impulse upon meeting the flow resistance imposed by orifice 34, which impulse may be detected either as a pressure differential by pressure switch 40 or as a change in the elevation of fluid within surge tube 36. Through either of these expedients, a control signal is generated for actuation of control elements in control unit 48 to be described hereinbelow. Of course, orifice 34 is provided with a sufficiently large opening to permit production flow of oil via piping 30 to holding tank 32, and imposes only a sufficient flow restriction to generate the magnitude and duration of pressure or flow surge impulse necessary to operate the control system as hereinbelow described.

Figure 3:
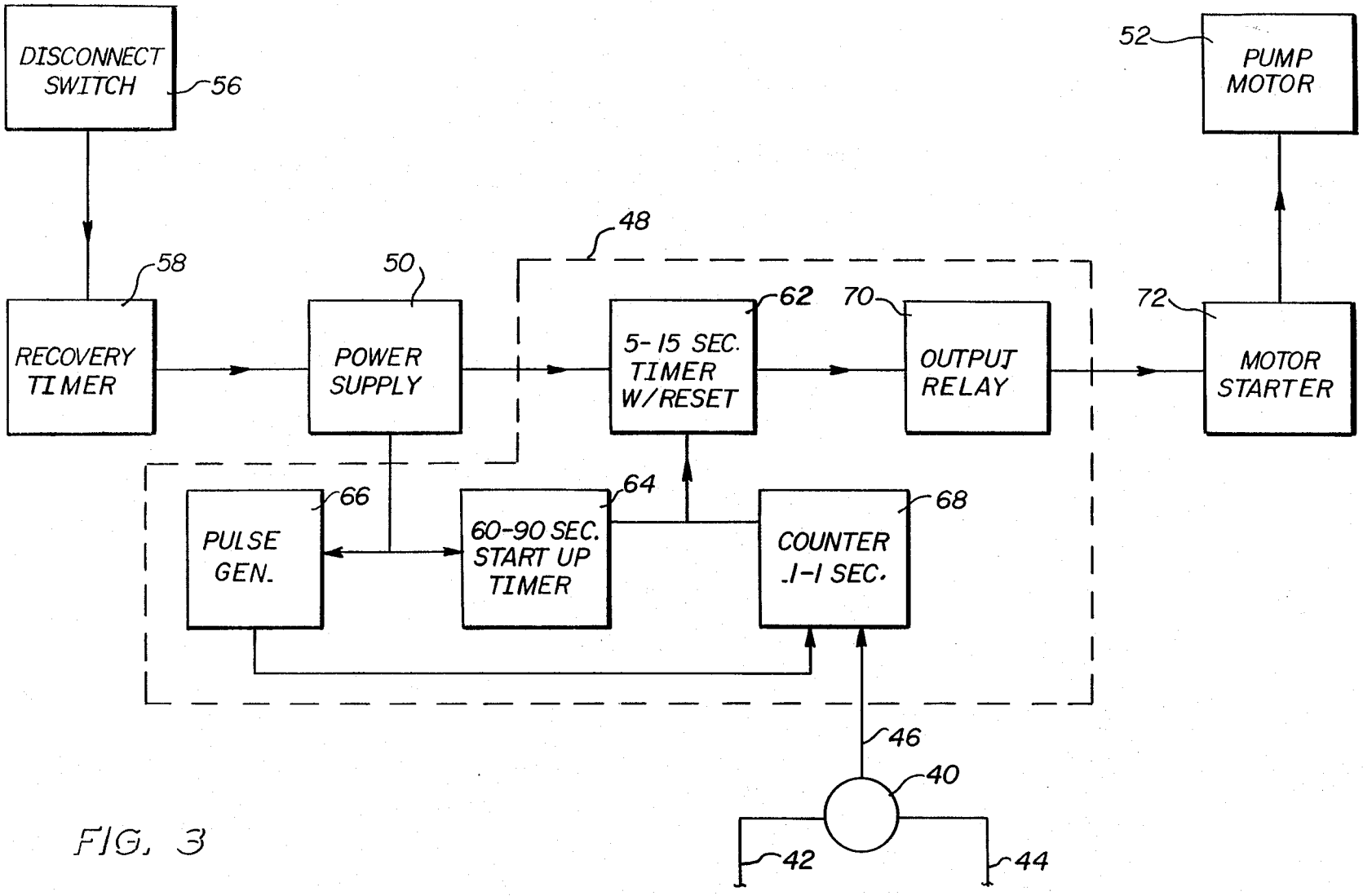
FIG. 3 is a simplified schematic block diagram showing functional elements of my novel well pump-off control system.

Referring to FIG. 3, control unit 48 comprises the control elements for operating the pumping jack motor 52 for the duration of a pumping cycle which begins when, with a main disconnect switch 56 closed, a recovery timer 58 is operative to initiate motive power supply from power supply 50 to operative elements within control unit 48. One such operative element is a resettable pump cycle timer 62 while another is a start-up timer 64 and a third is a pulse generator 66.

In a preferred embodiment of the method and apparatus of my invention, pressure switch 40 provides signals generated upon detection of a sufficient magnitude of fluid surge (detected as the pressure differential between detecting lines 42 and 44) to a counter 68 in control unit 48. Counter 68 compares the pressure differential signal from pressure switch 40 with a series of timed pulses from pulse generator 66 and transmits an actuating signal to timer 62 only when the pressure differential signal from switch 40 is of sufficient predetermined time duration. During an initial start-up period of pump operation, the operation of timer 62 is overridden (i.e. timer 62 is held in the reset mode) by start up timer 64 until timer 64 times out (e.g. in 60 to 90 seconds). Timer 62 is set to provide motive power from power supply 50 to an output relay 70 for a predetermined minimum time period (e.g. 5 to 15 seconds) whereby the pump motor 52 may operate for such predetermined minimum period or longer if timer 62 is reset by an actuating signal during its operating period.

Accordingly, an operating cycle of my novel well pump-off control system proceeds as follows. With main disconnect switch 56 on, recovery timer 58 is operating to periodically supply power to or actuate power supply 50. Power supply 50 thus is able, at intervals, to provide motive power to operate pump motor 52. Recovery timer 58 may be a clock timer which permits operation of power supply 50 for a given, predetermined interval of time each day or other predetermined period of time. Alternatively, the recovery timer 58 may be an interval timer which holds the power supply 50 off or non-operational for a predetermined, set period of time, but once the off period ends power supply 50 is able to provide power for operation of pump motor 52 for as long as other elements in the control system permit the pump to operate. Thus one advantage of an interval timer is that the well recovery time is set and predetermined whereas the pump motor operating time is governed by availability of well fluid to be pumped. Accordingly, in operation with an interval timer, unlike operation with a clock timer, the pumping jack will not shut down prematurely (by action of the recovery timer) while there is still fluid in the well pocket to be pumped.

When recovery timer 58 has timed out or otherwise reached a condition at which it actuates power supply 50, power is provided to resettable timer 62, start up timer 64 and pulse generator 66. This occurs only at the end of a well recovery period so that it is assured there is sufficient fluid in the well pocket for continuous pumping throughout at least a start-up time period. Accordingly, the actuation of start-up timer 64 begins an initial pumping period of, for example, 60 to 90 seconds, during which start-up timer 64 maintains resettable timer 62 in the reset mode. In this mode timer 62 permits motive power to flow via output relay 70 and a motor starter 72 to pump motor 52. Timer 62 is maintained by timer 64 in the reset mode for the duration of the start-up period, during which pumping jack operation develops the necessary pressure and/or flow surges for controlled operation of the pumping jack in accordance with the following.

As pumping jack 16 begins its reciprocal pumping action, fluid delivery via piping 30 to tank 32 also begins during the 60 to 90 second start-up time period. When the production system piping is filled with oil, each pumping stroke of pumping jack 16 is working against the flow resistance created by orifice 34. Thus, with each such stroke a fluid surge is created within piping 30 upstream of orifice 34. The resulting surge pressure differential between the higher upstream pressure and the lower downstream pressure on opposed sides of orifice 34, as detected by pressure transmitting lines 42 and 44, will close switch 40 only if of sufficient magnitude to do so and only for the time duration of the surge pressure pulse.

Switch 40 responds to a surge pressure differential of a magnitude which corresponds to a level of pressure indicating sufficient oil in the well pocket for continued pump operation. Accordingly, with each such operation of switch 40 in response to a pressure surge, an actuating signal is provided via line 46 to control Unit 48 where the duration thereof is measured by comparison in counter 68 with pulses from pulse generator 66. Pressure pulse duration is an important measure of well pump-off status because some active wells never completely pump-off. Measurement of the pulse duration thus permits differentiation between pumping strokes which deliver a full slug of fluid and those delivering a less than full slug with each stroke.

Thus, control signals resulting from pressure surges of at least a given magnitude and at least a given duration are transmitted to resettable timer 62 as they occur. With receipt of each such control signal, timer 62 is reset to begin timing out again from the beginning of a timing cycle, for example, a 5 to 15 second cycle. So long as timer 62 is operating within such a timing cycle and has not timed out, it will continue to provide power for operation of pumping motor 52. Thus, pumping will continue for as long as pumping strokes (which occur at a rate greater than one every 5 to 15 seconds, for example 12 to 16 strokes per minute) continue to provide actuating signals to reset timer 62 before it times out and discontinues power to pump motor 52.

If during a timing cycle of timer 62, a pressure pulse of sufficient magnitude and duration to provide a reset signal for timer 62 is not sensed, the timer 62 will time out and pump motor operation will cease. Accordingly, pump operation will never continue for more than 5 to 15 seconds after pressure pulse magnitude or duration falls below predetermined minimums established as a requisite for efficient well production.

As has been noted hereinabove, the production piping 30 may be provided with an upstanding surge tube 36 upstream of orifice 34, and having a suitable sensor such as a capacitive sensor 54. The flow resistance created by orifice 34 can result in both a pressure and a flow volume surge upstream thereof. Accordingly, a flow surge of oil upwardly into surge tube 36 may be utilized just as a pressure surge is utilized in providing control signals to control unit 48. Sensor 54 may be positioned to detect a predetermined minimum flow surge magnitude, and the duration of any such detected minimum flow surge may then be measured in counter 68 by comparison with timed signal pulses, or equivalent means. The resulting signal to resettable timer 62, if the minimum magnitude and duration limitations are met, has the same effect as hereinabove described with respect to detection and use of pressure pulse magnitude and duration.

The operating perameters for the above described operating system may, of course, be varied in accordance with well production conditions and desired results. For example, the time interval during which pumping may occur after a recovery period, and as controlled by the recovery timer, may vary within a wide latitude. Resettable timer 62 may operate for resettable cycle times of 5 to 15 seconds as noted, or a wider range of times preferably no more than 20 seconds and not less than 5 seconds. 12 seconds is one exemplary timing cycle for timer 62 which has been found to be suitable. Likewise, start-up timer 64 may operate within a range wider than the indicated 60 to 90 seconds, but preferably no greater than 180 seconds and no less than 15 seconds. Finally, counter 68 may provide a reset signal to timer 62 upon detection of any pulse of duration greater than, for example 0.1 to 1.0 seconds.

Figure 4:
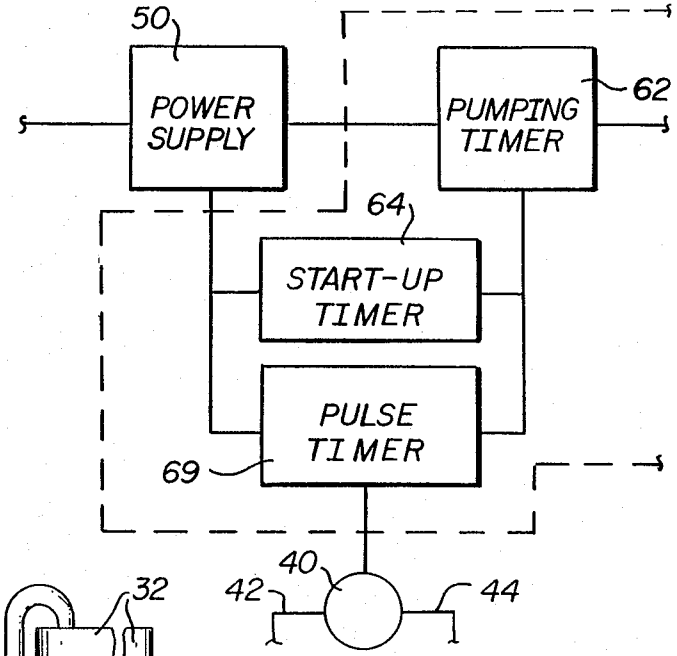
FIG. 4 is a partial schematic block diagram of an alternative well pump-off control system according to my invention.

In lieu of counter 68 and pulse generator 66, an on-delay timer (pulse timer 69, FIG. 4) may be employed to reset pumping timer 62 upon detection of a pressure pulse of sufficient magnitude from switch 40. According to this alternative, when pressure switch 40 closes in response to a pressure surge of a given minimum magintude, the resulting signal starts on-delay timer 69, which has been previously set to time out during a pressure surge of minimum acceptable duration. Thus, if the pressure surge is of sufficient duration, timer 69 times out and sends an actuating signal to reset the timer 62 and thereby continue pump operation. However, if the pressure surge is of insufficient duration, it will not maintain operation of timer 69 until it times out, and the reset signal to timer 62 thus will not occur. Accordingly, timer 62 will time out and cut off power to the pump.

From the above description it will be seen that I have invented a novel and improved control system and method for controlling operation of a pumping jack in a manner to discontinue pump operation whenever pumping strokes of the jack fail to deliver sufficient fluid flow to create a minimal, predetermined magnitude fluid behind a flow restriction in the well production piping.

The control components of my novel system are known, standard control components, each available from any number of suppliers. My invention resides not in the individual system components but in the operative combination thereof in the system as a whole, and in the novel method of pump control as described. Of course, I have contemplated various alternatives and modified embodiments of my invention in addition to the above presently preferred embodiments. Certainly such alternatives and modifications would also occur to others versed in the art once apprised of my invention. Accordingly, it is my intent that the invention be construed broadly and limited only by the scope of the claims appended hereto.

I claim:

1. A control system for regulating operation of a power driven pump in a well fluid production system wherein such a power driven pump is operable to pump fluid from a well bore and to deliver such fluid via a production flow path to a storage facility comprising:

a fluid surge amplifying means adapted to be disposed in such a production flow path and operable to amplify fluid surges occurring therein as a result of fluid movement occasioned by operation of such a pump;

surge detection means adapted to operatively communicate with such a production flow path to detect such amplified fluid surges occurring therein;

resettable timer means adapted to be operatively associated with such a power driven pump to initiate an operating cycle of such a pump upon resetting of said resettable timer means and to terminate the operating cycle of such a pump upon timing out of said resettable timer means after a given time period;

controller means operatively connected to said surge detection means and said resettable timer means and operable to reset said resettable timer means and thereby initiate a pump operating cycle upon each detection by said surge detection means of such an amplified fluid surge of at least a minimum given magnitude; and fluid surge duration measuring means which is operative upon each detected surge of fluid to provide an actuating signal for resetting of said resettable timer means only when the detected surge of fluid is of at least a minimum given duration.

2. The control system as set forth in claim 1 wherein said production flow path is production piping extending between such a well and such a storage facility, and said fluid surge amplifying means includes a fluid flow restriction means disposed in such production piping.

3. The control system as set forth in claim 2 wherein said surge detection means is adapted to operatively communicate with such production piping upstream from said flow restriction means.

4. The control system as set forth in claim 3 wherein said fluid surge duration measuring means detects the duration of fluid surges in said production piping upstream of said flow restriction means.

5. The control system as set forth in claim 4 additionally including start-up timer means operatively communicating with said resettable timer means to hold said resettable timer means in the reset state at initial pump start-up to thereby provide an initial pump operating cycle of greater duration than said period of resettable timer operation.

6. The control system as set forth in claim 5 wherein said surge duration measuring means includes counter means and a pulse generator means operatively communicating with said counter means to transmit thereto a series of timed pulses for comparison with each such detected fluid surge to measure the duration of each such fluid surge.

7. The control system as set forth in claim 5 wherein said surge duration measuring means includes an on-delay timer means which is operable to compare each such detected fluid surge with an on-delay timer operating cycle of predetermined minimum duration.

8. The control system as set forth in claim 4 wherein said flow restriction means includes an orifice means disposed in such production piping.

9. The control system as set forth in claim 8 wherein said surge detection means includes pressure switch means adapted to communicate with such production piping both upstream and downstream of said orifice means and operable to detect the magnitude of the pressure differential between the upstream and downstream sides of said orifice means.

10. The control system as set forth in claim 8 wherein said surge detection means includes an upstanding surge tube means adapted to communicate with such production piping upstream of said orifice means, and detector means operable to detect the level of fluid within said surge tube means.

11. In a well pumping system wherein a pumping jack is operable to provide impetus for drawing fluid from a well and for delivering the fluid via production piping to a storage facility, a method for controlling the duration of the well pump operating cycle comprising the steps of:

restricting the flow of such fluid within the production piping in a manner to amplify fluid surges occurring upstream of the point of flow restriction in the production piping;

detecting such fluid surges within the production piping;

in response to the occurrence of fluid surges of a given predetermined magnitude and time duration within the production piping, initiating a pump operating cycle of limited duration; and repeating said detecting and initiating steps with each fluid surge occurring in said production piping until said pump completes an operating cycle without occurrence of a fluid surge in said production piping of said given minimum magnitude and time duration.

12. The method as set forth in claim 11 wherein said initiating step additionally requires detection of fluid surges of a minimum given pressure.

13. The method as set forth in claim 11 wherein said initiating step additionally requires detection of fluid surges of a minimum given elevation within a surge chamber.

* * * * *